US006248999B1

(12) United States Patent
Mylchreest et al.

(10) Patent No.: US 6,248,999 B1
(45) Date of Patent: Jun. 19, 2001

(54) ASSEMBLY FOR COUPLING AN ION SOURCE TO A MASS ANALYZER

(75) Inventors: Iain C. Mylchreest, Gilroy; Kegi Tang, Cupertino, both of CA (US)

(73) Assignee: Finnigan Corporation, San Jose, CA (US)

( * ) Notice: Subject to any disclaimer, the term of this patent is extended or adjusted under 35 U.S.C. 154(b) by 0 days.

(21) Appl. No.: 09/160,502

(22) Filed: Sep. 24, 1998

(51) Int. Cl.[7] ..... H01J 49/04
(52) U.S. Cl. ..... 250/288; 250/281; 250/423 R
(58) Field of Search ..... 250/281, 288, 250/423 R

(56) References Cited

U.S. PATENT DOCUMENTS

| | | | | |
|---|---|---|---|---|
| 4,542,293 | | 9/1985 | Fenn et al. | 250/288 |
| 5,157,260 | | 10/1992 | Mylchreest et al. | 250/423 R |
| 5,581,081 | * | 12/1996 | Kato et al. | 250/288 |
| 5,736,741 | | 4/1998 | Bertsch et al. | 250/288 |
| 5,869,831 | * | 2/1999 | De La Mora et al. | 250/288 |
| 5,986,259 | * | 11/1999 | Hirabayashi et al. | 250/288 |

* cited by examiner

*Primary Examiner*—Jack Berman

(74) *Attorney, Agent, or Firm*—Flehr Hohbach Test Albritton & Herbert LLP

(57) ABSTRACT

An ion transmission system for transferring ions from an atmospheric pressure ionization source to an analyzer including a capillary having an input orifice which is indirectly coupled to the ion source.

7 Claims, 3 Drawing Sheets

ASSEMBLY FOR COUPLING AN ION SOURCE TO A MASS ANALYZER

BRIEF DESCRIPTION OF THE INVENTION

This invention relates generally to an atmospheric pressure ion source connected to a mass analyzer by an ion transfer assembly which includes a capillary passage, and more particularly to a capillary having a sample orifice which is not in the line of sight of the ion source.

BACKGROUND OF THE INVENTION

U.S. Pat. No. 5,157,260 shows a quadrupole mass filter coupled to an atmospheric pressure ion source by an ion transmission arrangement including a capillary, a conical skimmer and ion optics. A tube lens cooperates with the end of the capillary to force the ions into the center of the ion jet which travels through the conical skimmer. A quadrupole mass filter analyzes the transmitted ion beam to provide a mass spectrum.

U.S. Pat. No. 4,542,293 describes a capillary made of an electrical insulator for conducting ions out of the ionizing electrospray region at atmospheric pressure to a lower pressure region. A conductive coating is formed on the ends of the capillary and a voltage is applied thereacross to accelerate the ions. A skimmer is disposed adjacent the end of the capillary and is maintained at a voltage which causes further acceleration of the ions through the skimmer and into a lower pressure region which includes focusing lenses and analyzing apparatus.

In these and other prior art mass analysis systems, the orifice of the capillary passage which connects the atmospheric pressure chamber to a lower pressure chamber is in line with the outlet of the ion spray device which forms the sample ions for analysis. This arrangement provides excellent performance for the majority of solvent systems and flow regimes used in atmospheric pressure ion (API) analysis. However, when non-volatile buffer systems are used, there is the possibility of fouling of the capillary intake or sampling orifice by deposition of salts from undesolvated droplets that strike the sampling orifice and evaporate. The deposited salts gradually block the flow of sample ions and reduce performance of the overall system by progressively reducing the number of ions which are transmitted to the mass analyzer.

OBJECTS AND SUMMARY OF THE INVENTION

It is an object of the present invention to provide a capillary in which its sampling orifice is out of line of sight of the ion source.

It is another object of the present invention to provide an assembly for coupling an atmospheric pressure ion source to a mass analyzer which includes a capillary with a sampling orifice and an adaptor for indirectly coupling the sampling orifice to the ion source output such that fouling of the orifice is minimized.

The foregoing and other objects of the invention are achieved in a ion transmission assembly which couples an atmospheric pressure ion source to a mass analyzer by an assembly including a capillary having a sampling orifice opposite the ion source and an adaptor mounted on the sampling end of the capillary for indirectly coupling the orifice to the ion source output.

BRIEF DESCRIPTION OF THE DRAWINGS

The foregoing and other objects of the invention will be more clearly understood from the description to follow when read in conjunction with the accompanying drawings of which.

DESCRIPTION OF PREFERRED EMBODIMENT

Figure 1:
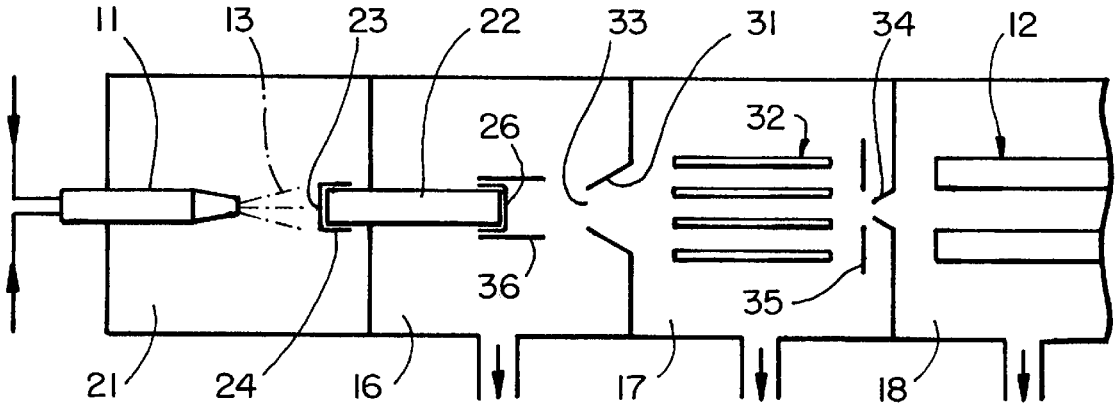
FIG 1 (PRIOR ART)
FIG. 1 shows an atmospheric pressure ion source coupled to a mass analyzer with an ion transmission assembly in accordance with the prior art.

Referring to FIG. 1, an atmospheric pressure ion source 11 is schematically shown coupled to a mass analyzer 12 by an ion transmission assembly. The ion source may comprise an electrospray ion source or corona discharge ion source. The ion source forms an ion spray 13. The ionization mechanism involves the desorption at atmospheric pressure of ions from the fine electrically charged particles formed by an electrospray source or a corona discharge source. The ion spray 13 may include undesolvated droplets particularly when non-volatile sample buffers are used.

The ion transmission assembly includes successive chambers 16, 17 and 18, maintained at successively lower pressures, with the mass analyzer 12 in the lowest pressure chamber. The first chamber 16 communicates with the atmospheric pressure ionization chamber 21 via a capillary tube 22. Due to the differences in pressure, ions and gas are caused to enter the orifice 23 of the capillary tube, and flow through the capillary passage into the chamber 16. A voltage is applied between conductive sleeves 24 and 26 at the ends of the non-conducting capillary tube to provide a voltage gradient which accelerates the charged ions.

The other end of the capillary is opposite a skimmer 31 which separates the chamber 16 from the chamber 17 which houses octopole lens 32. The skimmer includes a central orifice or aperture 33 which may be aligned with the axis of the bore of the capillary, or the capillary bore may be slightly off axis to reduce neutral noise as described in U.S. Pat. No. RE 35,413. A tube lens 36 cooperates with the end of the capillary to force ions into the center of the ion jet which leaves the capillary and travels through the skimmer 31. The octopole lens 32 is followed by ion optics which may comprise a second skimmer 34 and lens 35, which direct ions into the analyzing chamber 18 and into a suitable mass analyzer 12. The combination of capillary tube 22, skimmer 31, lens 32, skimmer 34 and lens 35 form the ion transmission assembly.

As described above, the entry orifice 23 of the capillary passage may be fouled by the deposition of salts from spray droplets and involatile material which strike the entrance orifice of the capillary and evaporate. The fouling is minimized in the present invention by indirectly coupling the sampling orifice to the ion source output so that it is no longer in the line of sight of the liquid droplets and involatile materials from the ion spray 13. An adaptor placed at the sampling end of the capillary prevents direct entry of the droplets and involatile material into the entrance orifice. The adaptor located at the entrance end of the capillary enables the indirect flow of ions into the sampling orifice. That is the orifice is not in direct line of sight of the ion source.

Figure 2:
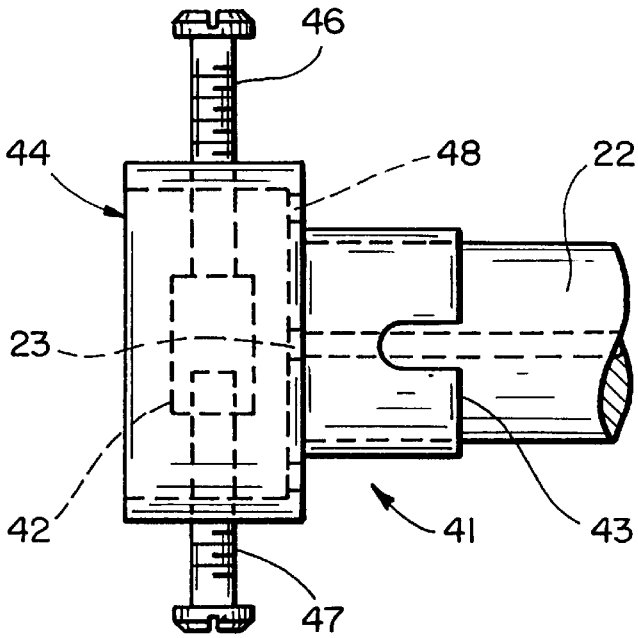
FIG. 2 is an enlarged view of a capillary adaptor assembly in accordance with one embodiment of the present invention.
Figure 3:
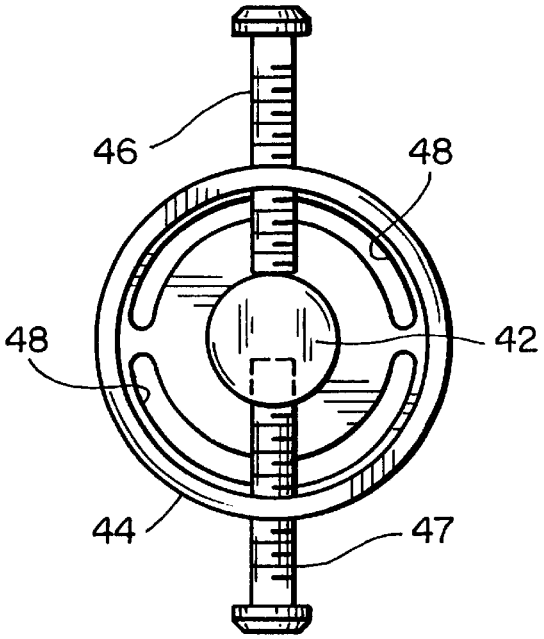
FIG. 3 is a front view of the adaptor of FIG. 2.
Figure 4:
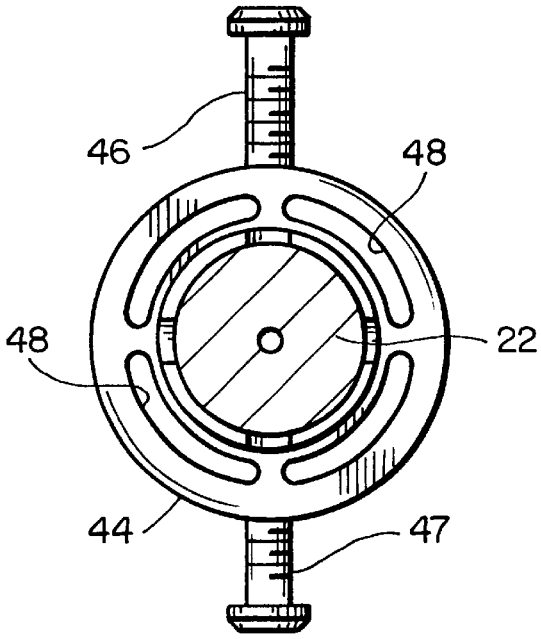
FIG. 4 is a rear view of the adaptor of FIG. 2.

The preferred embodiment shown in FIGS. 2–4 includes an adaptor 41 which supports a disk 42 opposite the capillary orifice 23. The disk prevents line of sight liquid and involatile material from impinging directly on the orifice. Consequently, sample ions are indirectly coupled from the ion source to the capillary orifice 23. The adaptor 41 includes a collar 43 which is inserted over the end of the capillary. The end of the collar 43 engages the cupshaped support 44. Suitable support means such as screws 46, 47 engage and support the disk 42. The bottom of the cup-shaped support 44 includes slots 48 which allow the liquid droplets and involatile materials to be diverted away or past the orifice 23. The desolvated ions pass around the outer edges of the disk 42 and into the axial capillary passages as a result of the pressure differential between the atmospheric chamber 21 and the lower pressure chamber 16. The adaptor prevents liquid droplets and involatile material build-up a the orifice 23.

Figure 5:
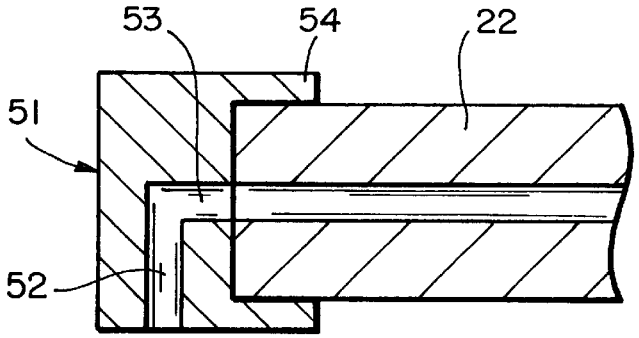
FIG. 5 is an enlarged sectional view of a capillary with another type of adaptor indirectly coupling the capillary input orifice to the ion source.
Figure 6:
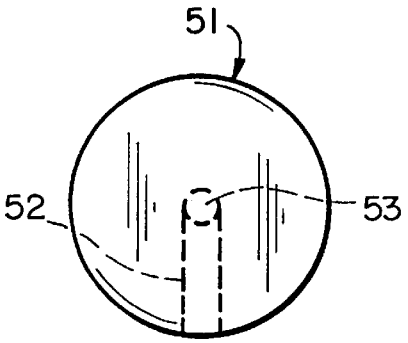
FIG. 6 is an end view of the adaptor of FIG. 5.
Figure 7:
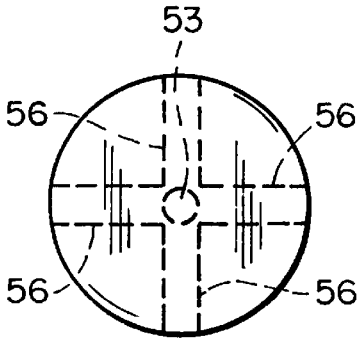
FIG. 7 is an end view of still another adaptor.
Figure 8:
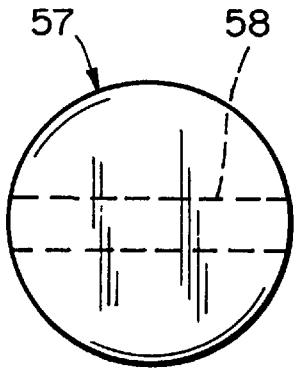
FIG. 8 is an end view of a slotted adaptor.
Figure 9:
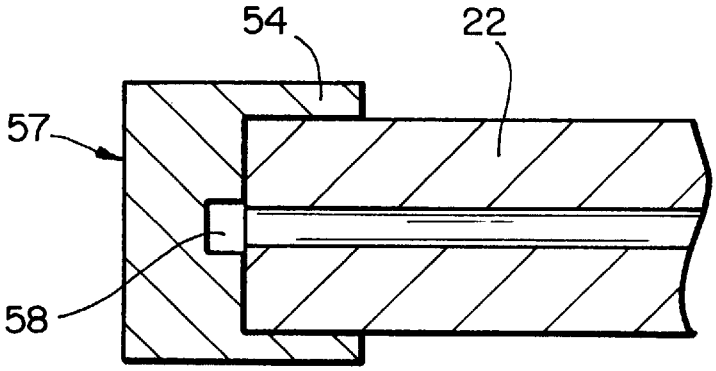
FIG. 9 is a side view of the slotted adaptor of FIG. 8.
Figure 10:
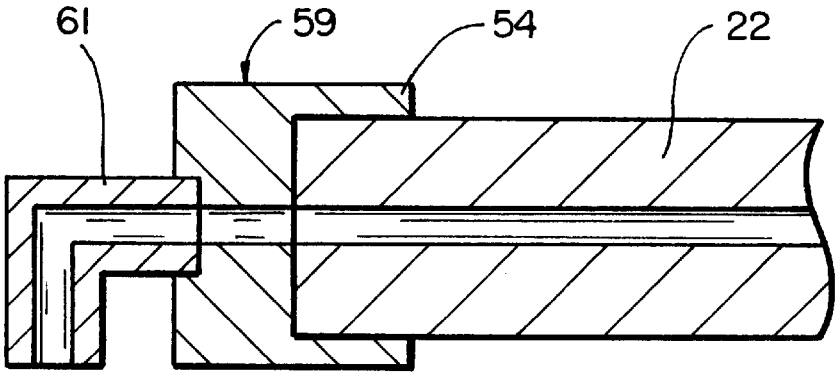
FIG. 10 is a side view of an adaptor having a bent tube.

FIGS. 5 and 6 show a disk-shaped adaptor 51 which has a radial passage 52 which terminates in an axial passage 53. The adaptor is suitably secured to the end of the capillary tube 22 by collar 54. This prevents liquid droplets from directly entering the capillary passage, but permits ions and gas to be sucked into the input orifice 23 of the capillary 22 through the passages 52, 53. FIG. 7 shows an adaptor with four radial passages 56 providing a greater flow of ions into the capillary 22. FIGS. 8 and 9 show an adaptor 57 which includes a slot 58 forming radial passages when the adaptor is secured to the capillary 22. FIG. 10 shows an adaptor 59 with a bent tube 61 which provides flow of ions to the capillary 22.

The embodiments of FIGS. 5–10 all prevent direct entry of droplets and involatile material into the capillary orifice 23. The adaptor may be used when needed without requiring the replacement of the capillary in mass analysis systems which are normally used with samples having volatile buffers. Furthermore, the adaptors can be replaced if contamination does occur, rather than having to replace the whole heated capillary.

Thus there has been provided an ion transmission system including a capillary and an adaptor which prevents direct line of sight between the ion source and the capillary orifice, whereby the capillary orifice is not fouled by deposited salts from evaporated liquid droplets or involatile material from the ion source.

What is claimed is:

1. An ion transmission system for transferring ions from an atmospheric pressure ion source to a mass analyzer including:

a capillary having an elongated axial capillary passage with its input end having an orifice opposite the ion source;

an adaptor having a collar adapted to fit over and be supported by the input end of the capillary including a radial passage which prevents direct line of sight from said input end orifice to said ion source while providing only a radial path for the flow of ions into said input end orifice whereby ions from said source are indirectly coupled to the input end orifice while liquid droplets and involatile material are prevented from directly impinging on the input end orifice whereby fouling of said orifice is minimzed.

2. An ion transmission system as in claim 1 in which said adaptor includes a disk supported between the ion source and spaced from the input end orifice to form the radial passage.

3. An ion transmission system as in claim 2 in which the disk is supported spaced from the input end orifice by a cup-shaped member supported from the capillary by the said collar.

4. An ion transmission system as in claim 3 in which the cup-shaped support includes a slotted bottom allowing droplets and involatile material to pass through the adaptor.

5. An ion transmission system as in claim 1 in which said adaptor includes a member having an adaptor passage in line with the input end orifice and capillary passage, and a passage extending at an angle with respect to said capillary passage whereby desolvated ions can pass through said adaptor passage to the capillary input orifice while fluid droplets and involatile materials flow past the passages.

6. An ion transmission system as in claim 5 in which said adaptor includes a plurality of passages extending at an angle.

7. An ion transmission system as in claim 1 in which said adaptor includes a slotted disk adapted to interface with the end of the capillary to define therewith radial passages whereby desolvated ions pass through said passage to the orifice and fluid droplets and involatile material flows past the passage.

* * * * *